US007522179B2

(12) United States Patent
Lysiak et al.

(10) Patent No.: US 7,522,179 B2
(45) Date of Patent: Apr. 21, 2009

(54) UNIVERSAL DONOR CARTRIDGE

(75) Inventors: Paul A. Lysiak, Rochester, NY (US); Joel S. Lawther, East Rochester, NY (US); Joseph A. Manico, Rochester, NY (US); John R. Fredlund, Rochester, NY (US); Kevin H. Blakely, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 256 days.

(21) Appl. No.: 11/479,853

(22) Filed: Jul. 3, 2006

(65) Prior Publication Data

US 2008/0002013 A1 Jan. 3, 2008

(51) Int. Cl.
*B41J 32/00* (2006.01)

(52) U.S. Cl. ..... 347/214

(58) Field of Classification Search ..... 347/214, 347/215, 217; 400/207, 208.1
See application file for complete search history.

(56) References Cited

U.S. PATENT DOCUMENTS

| | | | | |
|---|---|---|---|---|
| 4,978,240 | A | 12/1990 | Katsuno | |
| 6,504,564 | B1 | 1/2003 | Funaki et al. | |
| 6,522,349 | B1 | 2/2003 | Lee | |
| 7,151,555 | B2 * | 12/2006 | Kaida et al. | 347/214 |
| 7,217,047 | B2 * | 5/2007 | Maruyama | 400/207 |

FOREIGN PATENT DOCUMENTS

| | | | |
|---|---|---|---|
| DE | 3742337 | A1 | 6/1989 |
| EP | 0 294 792 | B1 | 8/1991 |
| EP | 0 869 009 | A2 | 10/1998 |
| EP | 0 857 580 | B1 | 4/2003 |
| JP | 05-169778 | | 7/1993 |
| JP | 05-254229 | | 10/1993 |

* cited by examiner

*Primary Examiner*—Huan H Tran
(74) *Attorney, Agent, or Firm*—Roland R. Schindler; Stephen H. Shaw

(57) ABSTRACT

A cartridge having a donor ribbon; a supply housing having an exterior surface and futher having a supply projection extending away from the exterior surface of the supply housing, said supply projection allowing the donor ribbon to pass from the supply area to a supply waypoint, and a take-up housing having an exterior surface and having a take-up projection extending away from the exterior surface of the take-up housing said take-up projection allowing the donor ribbon to pass from a take-up waypoint to the take-up area. A connecting portion holds the supply housing and the take-up spool with a separation area therebetween. said connecting portion providing a printing path from the supply waypoint to the take-up waypoint, wherein the supply waypoint is positioned at a supply side separation from supply housing and the take-up waypoint is positioned at a take-up separation from the take-up housing.

18 Claims, 9 Drawing Sheets

UNIVERSAL DONOR CARTRIDGE

FIELD OF THE INVENTION

The invention relates to thermal printer cartridges.

BACKGROUND OF THE INVENTION

A thermal printer prints images by transferring donor material from a donor ribbon onto a receiver medium. Typically, this is done by selectively heating the donor ribbon to melt donor material while concurrently pressuring the donor ribbon against the receiver medium. In this way, melted donor material transfers from the donor ribbon to the receiver medium to form an image while unmelted donor material remains on the donor ribbon. Upon initial transfer to the receiver medium, donor material is often liquid and hot. Within a short period of time, the donor material enters a transition or glassy state. After a longer period of time, the donor material solidifies forming a permanent record on the receiver medium. The donor ribbon and receiver medium are separated after transfer of the material to yield a receiver medium having a pattern of deposited donor material forming an image.

Donor ribbon is typically connected between a supply spool, which initially carries a supply of unused donor ribbon, and a take-up spool upon which used donor ribbon is wound. In operation, the take-up spool is rotated to draw donor ribbon from the supply spool and across the print head for use in printing.

Often the donor spool and take-up spool are joined together by a structural framework to form a thermal donor cartridge. This structural framework positions the supply spool and the take-up spool in a preferred geometric relationship to facilitate proper loading and can also be used to provide surfaces that enclose or otherwise protect the donor ribbon from damage due to incidental contact and from damage due to exposure to contaminants.

It will be appreciated that there are a wide variety of thermal printers that use thermal donor cartridges. Typically, each donor cartridge is adapted for use in one specific thermal printer. Accordingly, there are a wide variety of donor cartridges. For example, the conveyance system used to position the receiver medium can take any of several different forms depending on the type of printer. Some thermal printers use dual pinch roller receiver systems that enable a compact printer to create an image without white borders on the print. Other thermal printers use channel systems to move receiver medium during printing. Such channel systems enable an extremely low cost printer. Still other thermal printers use drum systems to move receiver medium during printing. Such drum systems have the potential for good color registration yet at a fairly large size on the desktop.

Thermal printers that use donor cartridges typically provide for printhead articulation so as to allow the printhead to be moved to a secure location during loading and unloading of the donor cartridge. Here too, a variety of approaches can be used to provide such printhead articulation. For example, small pivot head arms typically mate with drum type thermal printer systems while a long lever arm that pivots outside the distance of the spools is often used in roller receiver systems. Accordingly, the design of a thermal donor cartridge will typically be adapted to reflect this. Additional considerations and accommodations are made in thermal printer cartridges to facilitate the movement of donor ribbon so as to minimize donor ribbon wrinkle and other related problems.

Further, there are significant differences in the way in which donor ribbon is used in thermal printers. More specifically, many thermal printers are designed to separate donor ribbon from the receiver medium while the donor material is hot and is still in a liquid or molten state while other thermal printers separate the donor ribbon from the receiver medium only after the receiver medium has cooled for example to a solidified state. However, the donor cartridges that are designed for use in thermal printers that separate the donor web from the receiver medium while the donor material is hot are typically not compatible with donor cartridges that are designed for use in thermal printers that separate the donor web from the receiver medium when the donor material has cooled. Largely, this is because the latter printers require donor cartridges that are sized and shaped to allow the donor ribbon and receiver medium to travel in concert after printing to allow for cooling while the former printers separate the donor ribbon from the receiver medium soon after printing.

Because of these differences in thermal printers, a thermal donor cartridge is typically adapted for use in one printer and is rarely useful in different thermal printers. Accordingly, it is also known to provide donor ribbon in the form of a matched pair of donor spools and take-up spools that are joined only by the donor ribbon. Such an arrangement of donor ribbon allows the donor ribbon to be used in a variety of different printers in that the take-up and supply spools can be positioned at any distance relative to each other and in that such an arrangement imposes no inherent limitations on the path that the donor ribbon must take as it passes from the supply spool to the take-up spool. However, a person installing such donor ribbon in a thermal printer must exercise skill in handling and loading the donor ribbon to ensure that the spools and the donor ribbon are properly threaded through the donor ribbon travel path in the printer and must also use a care to ensure that the donor ribbon is not damaged, altered or contaminated.

What is needed in the art therefore is a low cost thermal printer cartridge that can be used with a wide variety of thermal printers.

SUMMARY OF THE INVENTION

In one aspect of the invention a cartridge is provided. The cartridge has a donor ribbon having sets of different donor material patches thereon; a supply housing having at least one exterior surface defining a supply area shaped to position a supply spool for rotation about a supply axis, said supply spool being connected to one end of a supply of donor ribbon, with the supply housing further having a supply projection extending away from the at least one of the exterior surface of the supply housing, said supply projection allowing the donor ribbon to pass from the supply area to a supply waypoint, and a take-up housing having at least one exterior surface defining a take-up area shaped to position a take-up spool for rotation about a take-up axis, said take-up spool being connected to another end of the donor ribbon, with the take-up housing having a take-up projection extending away from the at least one exterior surface of the take-up housing said take-up projection allowing the donor ribbon to pass from a take-up waypoint to the take-up area. A connecting portion holds the supply housing and the take-up housing apart on a common side of the connecting portion to form a separation area therebetween, said connecting portion providing a printing path from the supply waypoint to the take-up waypoint, wherein the arrangement of the supply projection, take-up projection and connecting portion further position the supply waypoint at supply side separation from supply housing and position the take-up waypoint at a take-up separation from the take-up housing.

DETAILED DESCRIPTION OF THE INVENTION

Figure 1:
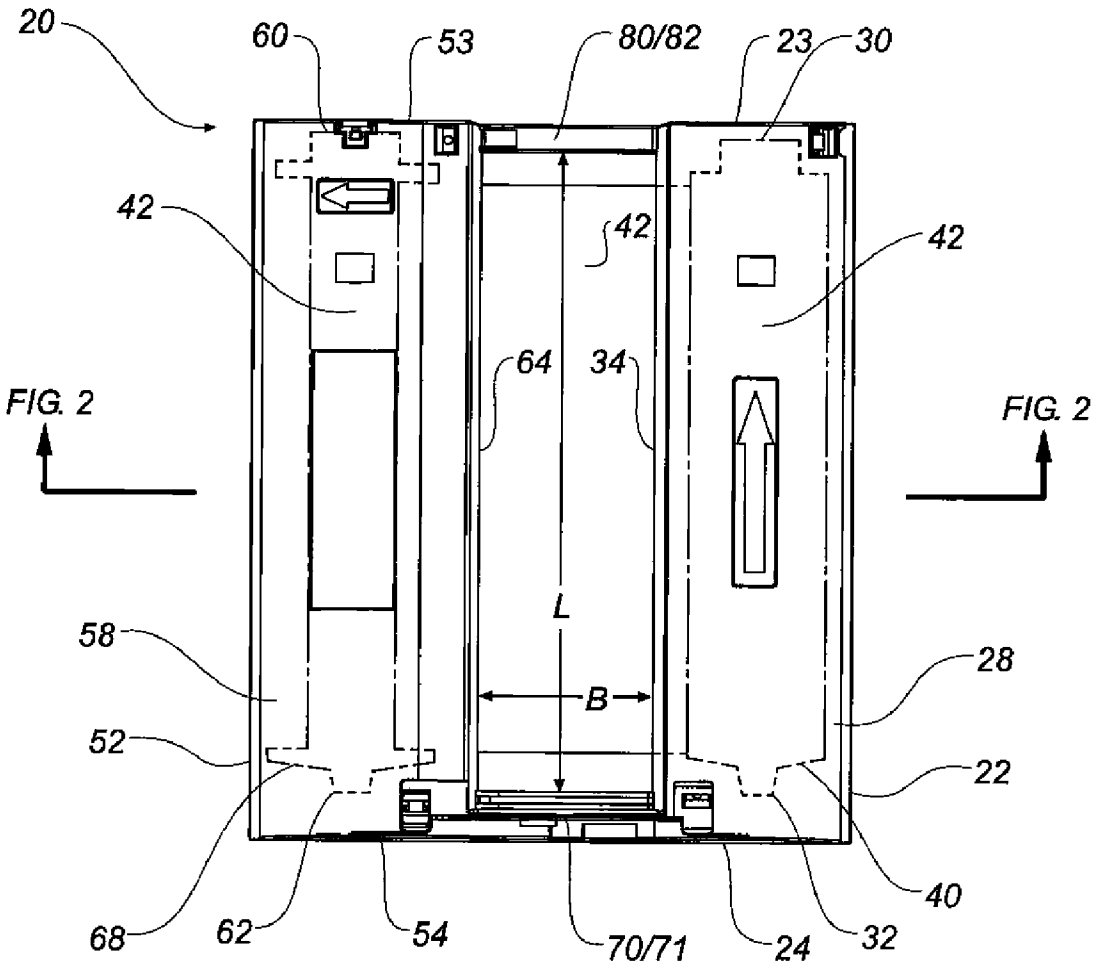
FIG. 1 illustrates a top view of one embodiment of the cartridge of the invention.
Figure 2:
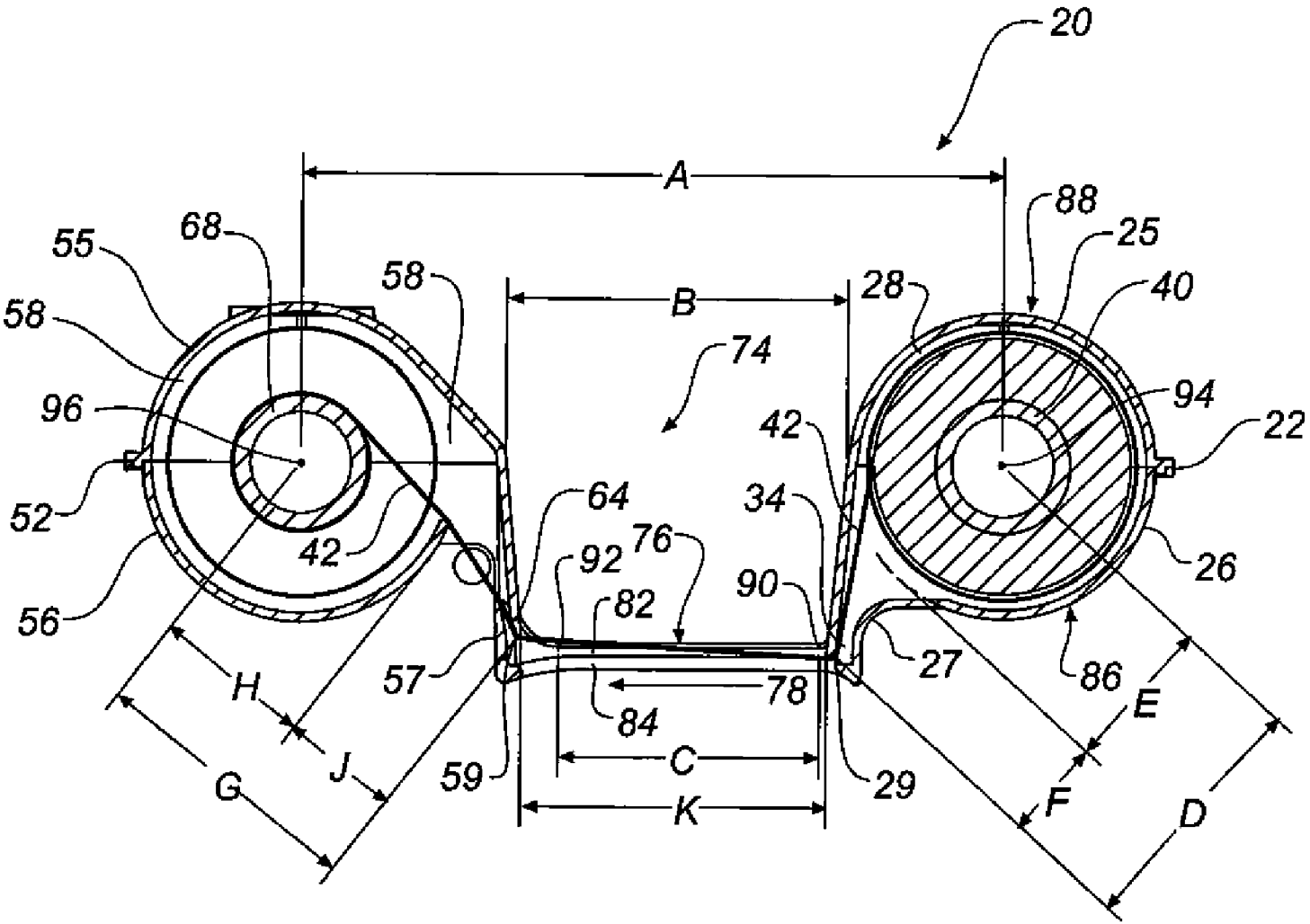
FIG. 2 illustrates a section view of the embodiment of FIG. 1.
Figure 3:
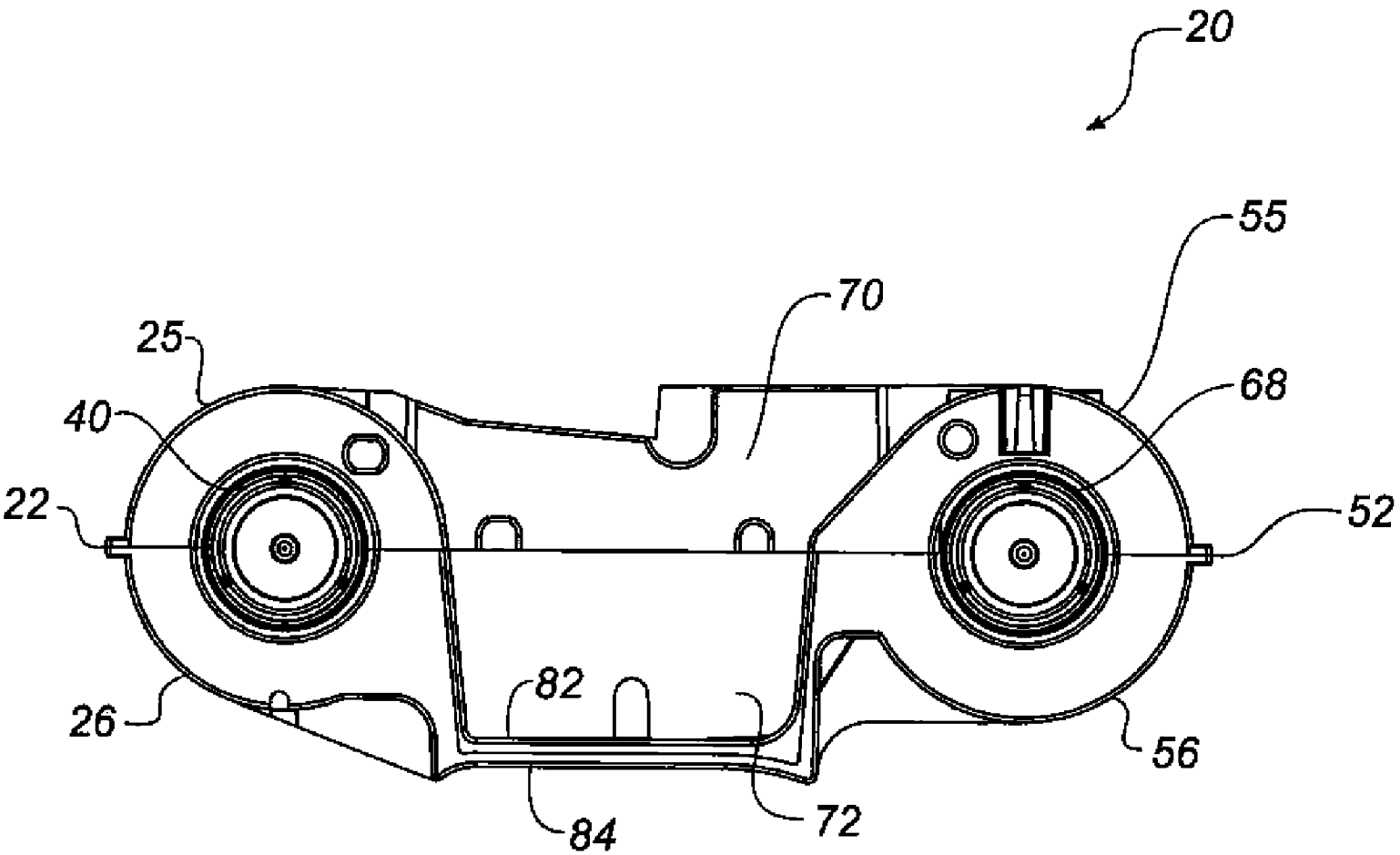
FIG. 3 illustrates a drive end view of the embodiment of FIG. 1.

FIGS. 1, 2 and 3 illustrate respectively a top, section and drive end side view of one embodiment of a thermal donor cartridge 20. In this embodiment, thermal donor cartridge 20 has a supply housing 22 with a drive end 23 and a non-drive end 24. In the embodiment illustrated, supply-housing 22 is formed from an upper exterior surface 25 and a lower exterior surface 26 that define a supply area 28. Bearing surfaces 30 and 32 are provided by supply housing 22 and are adapted to receive and position a supply spool 40 having a supply of donor ribbon 42 within supply area 28. Donor ribbon 42 typically comprises a plurality of patches of different donor material arranged thereon in sets. Such donor materials can include dyes, colorants, inks or any other thermally transferable image forming materials as well as overcoat materials such as generally transparent protective overcoat materials.

A supply projection 27 is connected to lower exterior surface 26 and extends away from lower exterior surface 26 to allow donor ribbon 42 to pass from supply area 28 to a supply waypoint 29. As is illustrated in FIG. 1, supply-housing 22 provides a supply window 34 through which donor ribbon 42 passes to supply projection 27.

Thermal donor cartridge 20 also has a take-up housing 52 with a drive end 53 and a non-drive end 54. In the embodiment illustrated, take-up housing 52 is shown having an upper exterior surface 55 and a lower exterior surface 56 that define a take-up area 58. Bearing surfaces 60 and 62 are provided by take-up housing 52 and are adapted to receive a take-up spool 68 that is connected to donor ribbon 42.

A take-up projection 57 extends away from lower exterior surface 56 to allow donor ribbon 42 to pass from a take-up waypoint 59 to take-up area 58. As is illustrated in FIG. 1, take-up housing 52 provides a take-up window 64 through which donor ribbon 42 can be received from take-up projection 57 so that donor ribbon 42 can pass from take-up waypoint 59 into take-up area 58 and onto take-up spool 68.

Supply housing 22 and take-up housing 52 are joined to and are held apart on a common side 71 of a connecting portion 70 to form a separation area 74 therebetween along a length of thermal donor cartridge 20. In the embodiment illustrated in FIGS. 1-3, connecting portion 70 comprises a drive end linkage 72 linking drive end 23 of supply housing 22 to drive end 53 of take-up housing 52, and a non-drive end linkage 80 linking non-drive end 24 of supply housing 22 to non-drive end 54 of take-up housing 52. Drive end linkage 72 and non-drive end linkage 80 extend for a distance to define a lateral separation between supply housing 22 and take-up housing 52.

Access window 76 allows printing structures to contact donor ribbon 42 so that at least a portion of donor ribbon 42 positioned along printing path 78 can be used for printing without substantially removing donor ribbon 42 from thermal donor cartridge 20. In practice this typically means that a thermal printhead (not shown) can be advanced against a top surface of donor ribbon 42 to drive donor ribbon 42 against a receiver medium (not shown) that is supported by a platen (not shown).

In this embodiment, supply waypoint 29 takes the form of a surface, which can be a stationary surface such as an edge of supply projection 27, a bar (not shown) or a rotating surface such as a shaft (not shown) around which donor ribbon 42 turns to enter a printing path 78. Printing path 78 extends from supply waypoint 29, through access window 76 to take-up waypoint 59. Donor ribbon 42 turns at take-up waypoint 59 for travel through take-up projection 64 to take-up area 58. Take-up waypoint 59 can be a stationary surface such as an edge of take-up housing projection 57, a bar (not shown) or a rotating surface such as a shaft (not shown) around which donor ribbon 42 turns while exiting printing path78.

In this way, thermal donor cartridge 20 provides a donor ribbon path that flows from supply housing 22, along supply projection 27, to supply waypoint 29 through connecting portion 70 along a printing path 78 to take-up waypoint 59, along take-up projection 57 and into take-up housing 52. Any of these structures can provide surfaces that contact donor ribbon 42 and that can be used as donor ribbon guides leading the donor ribbon 42 from supply housing 22 through supply side edge 90 of access window 76 to a take-up side edge 92 of access window 76 and to take-up housing 52. Accordingly, such donor ribbon guides can comprise the donor path.

In the embodiment illustrated in FIGS. 1-3, thermal donor cartridge 20 is formed by inserting supply spool 40 and take-up spool 68 into one of a lower housing 86 or an upper housing 88 and assembling the other of the lower housing 86 or upper housing 88 thereto. In this embodiment, drive end linkage 72 comprises, in this embodiment, an upper drive end linkage 82 provided by upper housing 88 and a lower drive end linkage 84 provided by lower housing 86.

It will be appreciated that in other embodiments, supply-housing 22, take-up housing 52, and connecting portion 70 can be formed using more or different components and using different assembly techniques.

FIG. 2 further illustrates geometric relationships between various dimensions of the embodiment of FIGS. 1, 2, and 3, that will be used in the following discussions of the design the parameters for the thermal donor cartridge 20. FIG. 2 shows a cross section view of thermal donor cartridge 20 taken along the line illustrated in FIG. 1.

As can be seen in FIG. 2, thermal donor cartridge 20 has a spool separation distance A defined as a separation between a supply spool axis 94 defined by bearing surfaces 30 and 32 for supply spool 40 and a take-up spool axis 96 defined by bearing surfaces 60 and 62 for take-up spool 68. Within the spool separation length A is separation area 74 between supply housing 22 and take-up housing 52. As noted above, separation area 74 extends along a horizontal length B between supply housing 22 and take-up housing 52.

Printing path 78 extends along a horizontal length K from supply waypoint 29 to take-up waypoint 59. Access window 76 extends along a horizontal length C of thermal donor cartridge 20 from a supply side edge 90 to a take-up side edge 92 of access window 76.

As is also shown in FIG. 2, the arrangement of supply housing 22, supply projection 27 and connecting portion 70 position supply waypoint 29 at a supply side waypoint offset D measured along a supply axis 94 to supply waypoint 29, while lower exterior surface 26 of supply housing 22 is positioned at a supply housing offset E measured along supply axis 94. As is shown in FIG. 2, supply side waypoint offset D is larger than supply housing offset E. This creates a supply side separation F. As will be discussed and illustrated in greater detail below, supply side separation F is intended to provide sufficient separation to allow a pinch roller to be positioned proximate to supply waypoint 29 so that thermal donor cartridge 20 can be used in thermal printers that utilize a dual pinch roller receiver system to move a receiver medium during printing.

Similarly, the arrangement of take-up housing 52, take-up projection 57, and connecting portion 70 position take-up waypoint 59 at a take-up side waypoint offset G measured along a take-up axis 96 from supply waypoint 59 to take-up spool axis 96, while lower exterior surface 56 of take-up housing 52 is positioned at a take-up housing offset H measured along take-up axis 96. As is shown in FIG. 2, take-up waypoint separation G is larger than take-up housing offset H. This creates a take-up side separation J. As will be discussed and illustrated in greater detail below, take-up side separation J is intended to provide sufficient separation to allow a pinch roller to be positioned proximate to take-up waypoint 59 so that thermal donor cartridge 20 can be used in thermal printers that utilize a dual pinch roller receiver system to move a receiver medium during printing.

In some embodiments of thermal donor cartridge 20, a ratio of the supply side waypoint offset distance D to the supply side housing offset distance E is between about 1.3 to 1.9, while in other embodiments this ratio can be between about 1.5 to 1.75. Further, in certain embodiments of thermal donor cartridge 20 a ratio of take-up waypoint offset distance G to take-up side housing offset distance H (G/H) is within a range of about 1.6 to 2.5 while in other embodiments, this ratio can be between about 1.70 to 1.90. Additionally, a ratio of spool separation distance A to the sum of the length of access window C plus the supply waypoint offset distance D plus the take-up waypoint offset distance G (A/(C+D+G) is between about 0.5 to 0.95.

As is also illustrated in the embodiment of FIGS. 1-3, the width of access window 76 is B between the drive end linkage of the drive end 82/84 to the length of non-drive end linkage 82 is L.

FIGS. 4-9 provide examples of the use of thermal donor cartridge 20 of FIGS. 1-3 in three different printer types and demonstrates how various characteristics of this embodiment enable thermal donor cartridge 20 to be used in such different thermal printers.

Figure 4:
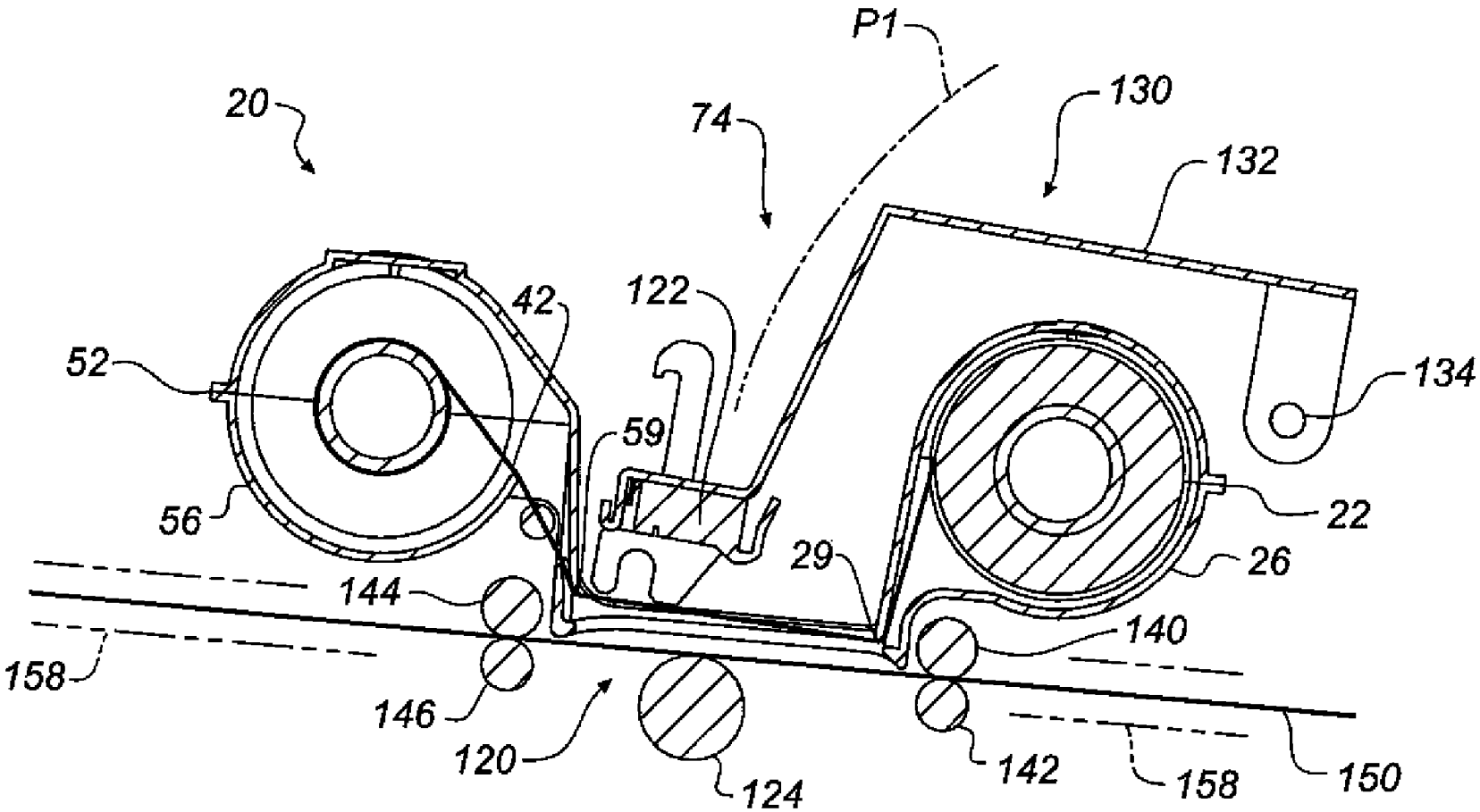
FIGS. 4 and 5 illustrate one embodiment of a thermal printer cartridge used in a pinch roller printer.
Figure 5:
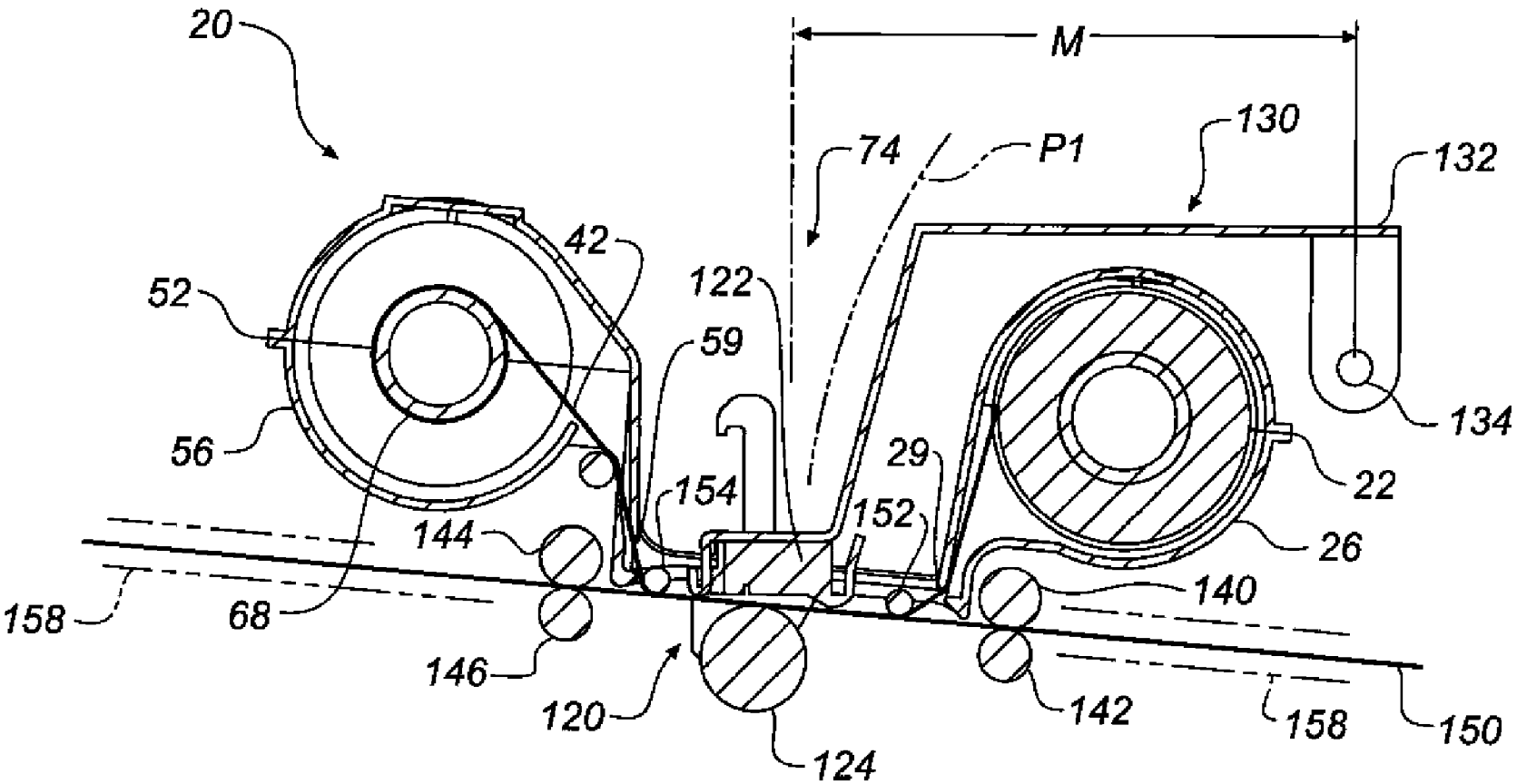

FIGS. 4 and 5 illustrate a first use of thermal donor cartridge 20 in a print area 120 of a dual capstan type thermal printer. As illustrated in FIG. 4, during a loading operation, a thermal printhead 122 is pivotally moved by a printhead positioning mechanism 130 between a loading position (FIG. 4) and a printing position (FIG. 5). In this embodiment, printhead-positioning mechanism 130 comprises: a pivot arm 132 that is joined at one end to thermal printhead 122 and at another end to a pivot 134. Pivot arm 132 can be moved between the loading position and the printing position by an actuator (not shown), or manually. As is shown in FIGS. 4 and 5, pivot 134 is outside of separation area 74 when thermal donor cartridge 20 is located in print area 120. accordingly, only a portion of printhead positioning mechanism 130 is within the separation area 74.

In such a print area 120 of dual capstan type of printer, receiver medium 150 is moved past thermal printhead 122 and platen 124 by gripping receiver medium 150 with one or the other of two pairs of motorized pinch rollers. In the embodiment of FIGS. 4 and 5 such pinch roller pairs are illustrated on the supply side as an upper supply side pinch roller 140 and as a lower supply side pinch roller 142. Upper supply side pinch roller 140 is positioned opposing lower supply side pinch roller 142 across a receiver medium movement path 158 to grip receiver medium 150 (shown in FIGS. 4 & 5) and to move receiver medium 150 during printing. Similarly, an upper take-up side pinch roller 144 is shown opposing a lower take-up side pinch roller 146 across receiver medium movement path 158 to move receiver medium 150 during printing.

As shown in FIG. 4, when thermal donor cartridge 20 is loaded into print area 120 of a dual capstan type printer, upper supply side pinch roller 140 is positioned proximate to supply waypoint 29. This is made possible because the supply side separation F between the supply waypoint 29 and supply housing 26 is sufficiently large to receive at least a portion of upper supply side pinch roller 140. The size of such a supply side separation F can be defined in various ways. Typically, the length of supply side separation F is defined as the extent of separation required to allow upper supply side pinch roller 140 to be positioned between lower exterior surface 26 of supply housing 22 and the generally flat receiver medium movement path 158. In many cases, the length of supply side separation F will be of an extent that is necessary to enable upper supply side pinch roller 140 to grip receiver medium 150 during printing without forcing receiver medium 150 to deviate meaningfully from the generally flat receiver medium movement path 158. It will be appreciated however, that in other embodiments of a dual capstan type printer wherein receiver medium movement path 158 is not generally flat, the supply side separation F can extend by a distance that is sufficient to permit a receiver medium 150 to follow such a non-flat receiver medium movement path.

As is also shown in FIG. 4, when thermal donor cartridge 20 is loaded into print area 120 of a dual capstan type printer, an upper take-up side pinch roller 144 is positioned proximate to take-up waypoint 59. This is made possible because the take-up side separation J between the take-up housing 56 and the take-up waypoint 59 is sufficiently large to receive at least a portion of upper take-up side pinch roller 144. The size of such a take-up side separation J can be defined in various ways. Typically, the length of take-up side separation J is defined as the extent of separation required to allow upper take-up side pinch roller 144 to be positioned between lower exterior surface 56 of take-up housing 52 and the generally flat receiver medium movement path 158. In many cases, the take-up side separation J will be of an extent that is necessary to allow upper take-up side pinch roller 144 and lower take-up side pinch roller 146 to grip receiver medium 150 during printing without forcing receiver medium 150 to deviate meaningfully from the generally flat receiver medium movement path 158. It will be appreciated however, that in other embodiments of a dual capstan type printer wherein receiver medium movement path 158 is not generally flat, take-up side separation J can be defined as a separation that is necessary to permit a receiver medium 150 to follow such a receiver medium movement path 158.

Using this method, such pinch roller pairs can held close to a nip between the thermal printhead 122 and platen 124 in order to minimize the receiver length between them. This minimizes the unsupported travel distance of receiver medium 150 during printing so that the beam strength stiffness of receiver medium 150 is maximized during printing. It will be appreciated that the stronger the beam strength of this portion of receiver medium 150 during printing, the less likely that it is that receiver medium 150 will buckle during printing thus reducing the risk of mis-registration and other errors that can arise.

As is shown in FIG. 5, during printing, pivot head arm 132 pivots along a first arcurate path P1 about pivot 134 to move between a printing position wherein thermal printhead 122 applies pressure against donor ribbon 42, donor ribbon 42 applies pressure against receiver medium 150 and receiver medium 150 applies pressure against platen 124. Thermal printhead 122 then selectively applies heat to donor ribbon 42 to cause donor material to transfer to receiver medium 150. As is shown in FIG. 5, a printer supplied contact roller 152 brings donor ribbon 42 in contact with receiver medium 150 during printing and a printer supplied peel roller 154 separates donor ribbon 42 from receiver medium 150 after printing. It will be appreciated that in this regard, the horizontal length C (see FIG. 2) of access window 76 is sized to allow each of contact roller 152, peel roller 154, thermal printhead 122, and platen roller 124 to engage donor ribbon 42.

It will be appreciated that where a thermal donor cartridge 20 is used in a print area 120 that uses a structure such as printhead positioning mechanism 130 it is useful for thermal donor cartridge 20 to be shaped to permit pivot arm 130 (or any other printhead positioning system) to move thermal printhead 122 between a printing position and a non-printing position which. Accordingly, in embodiments where such use is desired, thermal donor cartridge 20 can have a donor perimeter extension length M (not illustrated) that is defined to enable a pivot arm 132 that pivots about pivot 134 to be positioned outside a perimeter of thermal donor cartridge 20 so that pivot arm 132 can move a printhead that is within separation 74 between a printing position and a non-printing position. In this embodiment, this is done by providing a donor perimeter extension length M that is sum of an available loop for a thermal print head to engage donor ribbon 42 where M is determined as the sum of one half the access length B, the take-up waypoint offset distance D and the take-up offset distance E.

As is also illustrated in FIG. 5, take-up waypoint 59 is positioned so that when thermal printer cartridge 20 is used for printing, a printer roller 154 can be positioned at access window 74 in printing path 78 to allow the donor ribbon 42 to pass from printer roller 154 to take-up spool 68 without contacting any surface of thermal printer cartridge 20. In particular it will be appreciated that donor ribbon 42 does not contact a surface constituting take-up waypoint 59.

Figure 6:
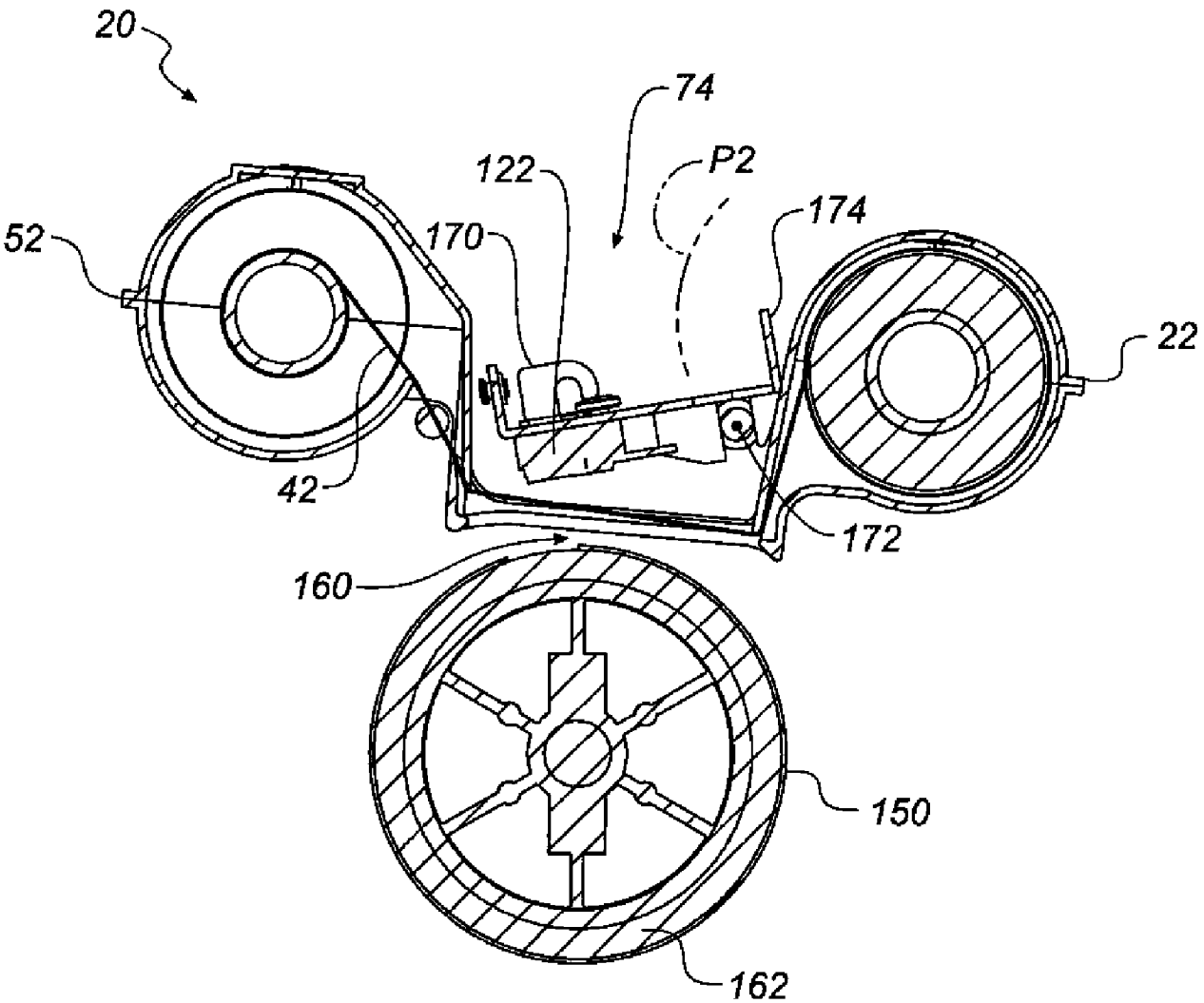
FIGS. 6 and 7 illustrate the thermal printer cartridge of FIG. 1 used in a drum type printer.
Figure 7:
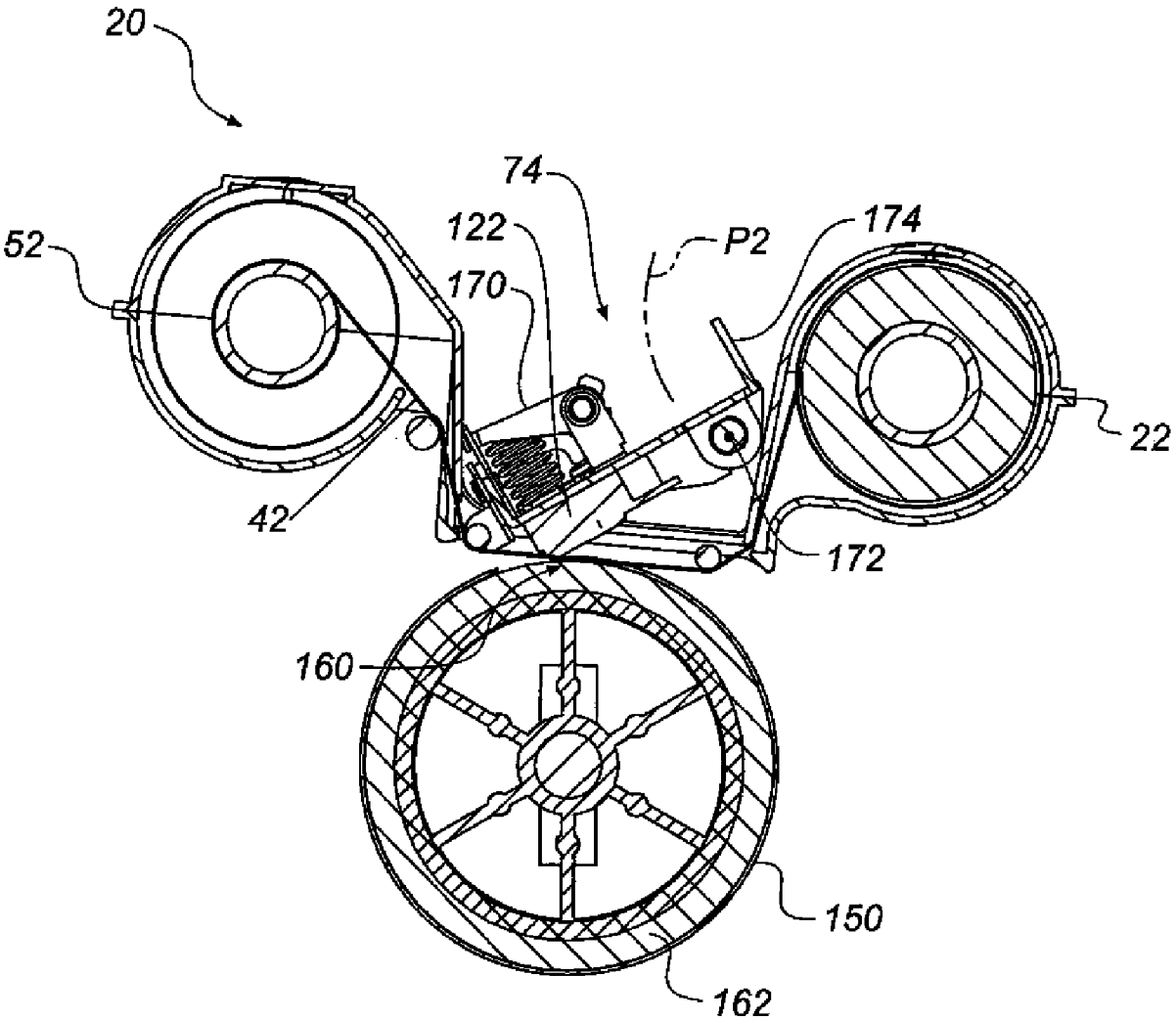

FIGS. 6 and 7 show thermal printer cartridge 20 in a print area 160 of a drum type thermal printer. In this example, print area 160 has a printhead 122 as generally described above and a drum 162. Receiver medium 150 is positioned against drum 162 during printing by clamps, vacuum, electrostatic attraction, rollers, or other known structures (not shown). During printing, drum 162 positions receiver medium 150 opposite from printhead 122 and acts as a platen so that printhead 122 can apply force against donor ribbon 42.

Printhead 122 is movable between a loading position illustrated in FIG. 6 and a printing position illustrated in FIG. 7. As is shown in FIG. 6, during loading a printhead positioning system 170 provides a printhead movement path P2 that is within separation area 74. In particular, in this embodiment, printhead positioning system 170 provides a pivot 172 that is within separation area 74 and about which an arm 174 pivots to cause printhead 122 to move along a second arcurate path P2 between the load position and the printing position. Such a system requires more space between supply housing 22 and take-up housing 52 than does the printhead positioning system 130 having an exterior pivot 134 but imposes no limitation on the size of access window 76 between printhead 122 and the far end of thermal donor cartridge 20. As is shown in FIGS. 4-7, supply housing 22, take-up housing 52 and connecting portion 70 are defined so as to provide a separation area 74 that can accommodate both of a relatively large first arcurate path P1 and a relatively smaller second arcurate path P2 with the ratio of the first arcurate path P1 to the second arcurate path P2 (P1/P2) being in the range of about 1.2 to 3.5.

Figure 8:
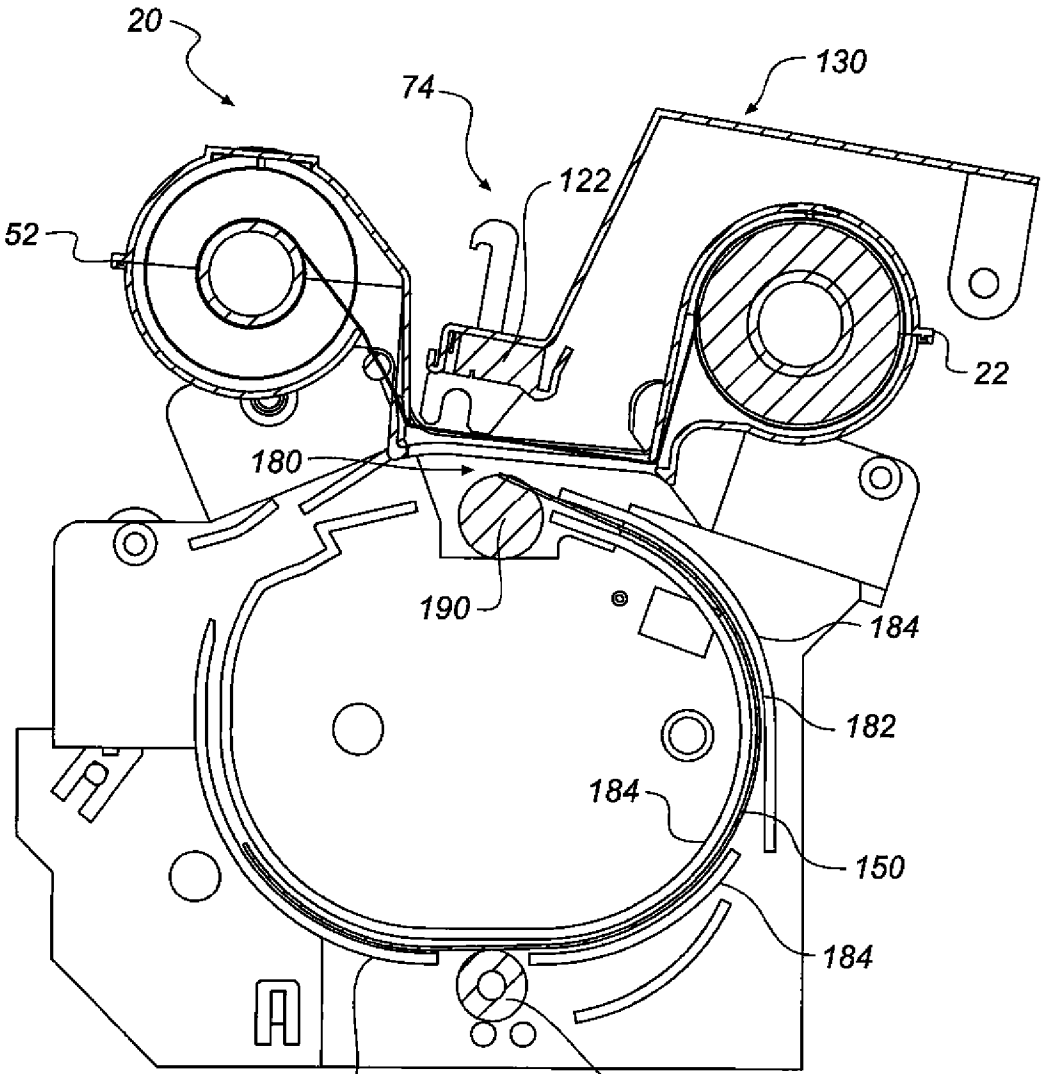
FIGS. 8 and 9 illustrate the thermal printer cartridge of FIG. 1 used in a channel receiver printer.
Figure 9:
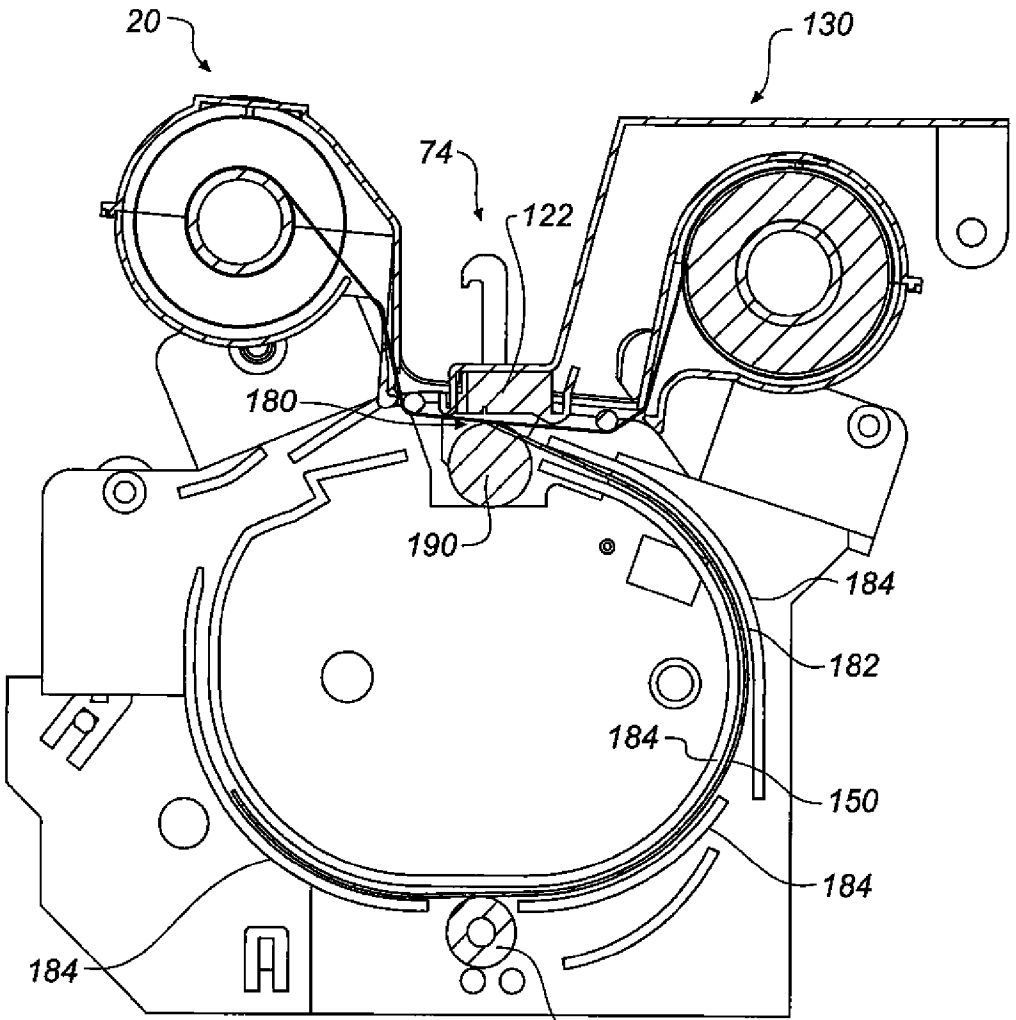

FIGS. 8 and 9 show thermal donor cartridge 20 in a print area 180 of a platen drive type printer. In this embodiment, print area 180 has a receiver medium path 182 comprising generally a set of receiver medium guides 184, at least one urge roller 186, and a platen 190. Receiver medium guides 184 provide a path for receiver medium 150 to move between urge roller 186 and platen 190. A detailed description of one embodiment of such a platen drive type printer is illustrated in FIGS. 8 & 9.

It will be appreciated that the separations F and J used to make thermal printer cartridge 20 useful in a dual capstan type printer of the type illustrated in FIGS. 4 and 5 do not interfere with use of thermal donor cartridge 20 in the platen drive type printer illustrated in FIGS. 8 and 9. Further it will be appreciate that separation area 74 is sized appropriately to receive a printhead positioning mechanism, similar to printhead positioning mechanism 130 used in this embodiment of a platen drive printer. These accommodations do not interfere with the use of the thermal printer cartridge 20.

It will be appreciated that in any of the above described embodiments, a supply projection 27 can be shaped so that the supply projection 27 enables an upper supply side pinch roller 142 to be positioned proximate to the supply waypoint 29.

The invention has been described in detail with particular reference to certain preferred embodiments thereof, but it will be understood that variations and modifications can be effected within the spirit and scope of the invention.

PARTS LIST

20 thermal printer cartridge
21
22 supply housing
23 drive end
24 non-drive end
25 upper exterior surface
26 lower exterior surface
27 supply projection
28 supply area
29 supply waypoint
30 bearing surface
32 bearing surface
34 supply window
40 supply spool
42 donor ribbon
52 take-up housing
53 drive end
54 non-drive end
55 upper exterior surface
56 lower exterior surface
57 take-up projection
58 take-up area
59 take-up waypoint
60 bearing surface
62 bearing surface

64 take-up window
68 take-up spool
70 connecting portion
71 common side of connecting portion
72 drive end linkage
74 separation area
76 access window
78 printing path
80 non-drive end linkage
82 upper drive end linkage
84 lower drive end linkage
86 lower housing
88 upper housing
90 supply side edge of access window
92 take-up side edge of access window
94 supply spool axis
96 take-up spool axis
100 upper housing
102 lower housing
120 print area
122 printhead
124 platen
130 printhead positioning mechanism
132 pivot head arm
134 pivot point
140 upper supply side pinch roller
142 lower supply side pinch roller
144 upper take-up side pinch roller
146 lower take-up side pinch roller
150 receiver medium
152 contact roller
154 peel roller
160 print area
162 drum
170 printhead positioning system
172 pivot
174 arm
180 print area
182 receiver medium path
184 receiver medium guides
186 urge roller
190 platen
A spool separation distance
B separation area horizontal length
C horizontal length of access window
D supply side waypoint offset
E supply housing offset
F supply side separation
G take-up side waypoint offset
H take-up housing offset
J take-up side separation
K horizontal length between waypoints
L width of donor ribbon
M donor perimeter extension length
P1 first arcurate path
P2 second arcurate path

The invention claimed is:

1. A cartridge comprising:

a donor ribbon having sets of different donor material patches thereon;

a supply housing comprising at least one exterior surface defining a supply area shaped to position a supply spool for rotation about a supply axis, said supply spool connecting to one end of a supply of donor ribbon, said supply housing further comprising a supply projection extending away from said at least one of said exterior surface of said supply housing, said supply projection allowing said donor ribbon to pass from said supply area to a supply waypoint;

a take-up housing having at least one exterior surface defining a take-up area shaped to position a take-up for rotation about a take-up axis, said take-up spool being connected to another end of said donor ribbon, with said take-up housing having a take-up projection extending away from said at least one exterior surface of said take-up housing said take-up projection allowing said donor ribbon to pass from a take-up waypoint to said take-up area; and a connecting portion holding said supply housing and said take-up housing apart on a common side of said connecting portion to form a separation area therebetween, said connecting portion providing a printing path from said supply waypoint to said take-up waypoint;

wherein said arrangement of said supply projection, said take-up projection and said connecting portion further position said supply waypoint at a supply side separation from said supply housing and position said take-up waypoint at a take-up separation from said take-up housing; and wherein said supply housing. said take-up housing and said connecting portion associate to form a separation area for moving printhead alternatively along a first accurate path about a pivot outside said separation area or a second accurate path about a pivot within said separation area.

2. The cartridge of claim 1, wherein said supply waypoint separates from said supply spool axis by an extent sufficient to receive a pinch roller and further to position said take-up waypoint apart from said take-up spool axis by an extent sufficient to receive a pinch roller.

3. The cartridge of claim 1, wherein the supply projection extends away from said supply housing by a length sufficient to position an access window in said connecting portion at a supply side separation from said supply housing of sufficient size to receive a supply side pinch roller between a generally flat receiver medium movement path and said supply housing.

4. The cartridge of claim 1, wherein said separation area comprises a length sufficient to allow a first printhead mechanism in a first printer and a second printhead mechanism in a second printer to move between a printing position against said donor ribbon and a loading position separated from said donor ribbon, wherein said first printhead mechanism uses at least twice the space than the second printhead mechanism.

5. The cartridge of claim 1, wherein supply housing, take-up housing and connecting portion are defined so as to provide a separation area for accommodating a printhead moveable by a printhead mechanism alternatively along either of a relatively large first accurate path P1 and a relatively smaller second accurate path P2 with said ratio of the first accurate path P1 or a second accurate path P2 (P1/P2) being in said range of about 1.2 to 3.5.

6. The cartridge of claim 1, wherein said take-up waypoint associates with said thermal printer cartridge to allow positioning, a printer roller at an access window in said printing path for directing said donor ribbon to pass from said printer roller to said take-up spool without contacting any surface of said thermal printer cartridge.

7. The cartridge of claim 1, wherein said take-up waypoint associates with said thermal printer cartridge is to allow positioning, a roller at an access window in said printing path for directing said donor ribbon to pass from said printer roller to said take-up spool without contacting any surface constituting said take-up waypoint.

8. A cartridge for use in a pinch roller receiver type printer, a platen drive printer and a drum drive printer; said cartridge comprising:

a donor ribbon having sets of different donor patches therein;

a supply housing defining a supply area holding a supply spool having a supply of donor ribbon thereon;

a take-up housing defining a take-up area holding a take-up spool connected to said donor ribbon;

donor ribbon guides leading said donor ribbon from the supply housing through a supply end of an access window to a take-up edge of said access window to a take-up edge of said access window, and to the take-up housing;

a connecting portion holding the supply housing and the take-up housing in a spaced apart relation along a length of the donor cartridge along the length of the cartridge;

wherein said donor ribbon guides position a supply side edge of the access window apart from the supply housing by a supply side separation that is sufficient to receive a supply side pinch roller and further position the take-up edge of the access window apart from the take-up housing by an extent sufficient to allow the cartridge to be used in printers that utilize pinch rollers; and wherein supply housing, take-up housing and connecting portion are defined so as to provide a separation area that can accommodate a printhead moved by a mechanism along either of a relatively large first accurate path about a pivot that is outside said separation area and a second accurate path about a pivot that is within the separation area.

9. The cartridge of claim 8, wherein the take-up waypoint is positioned so that when the thermal printer cartridge is used for printing, a printer roller can be positioned at the access window to allow the donor ribbon to pass from the roller to the take-up spool without contacting any surface constituting the take-up waypoint.

10. The cartridge of claim 8, wherein the take-up waypoint is positioned so that when the thermal printer cartridge is used for printing, a roller can be positioned against the donor ribbon at the access window to position the donor ribbon to allow the donor ribbon to pass from the roller to the take-up spool without contacting any surface of the thermal printer cartridge.

11. A cartridge for a thermal donor ribbon comprising sets of different donor material patches, the cartridge comprising:

a supply spool having a supply of donor ribbon thereon;

a supply housing positioning said supply spool for rotation about a supply axis;

a take-up spool linked to a take-up end of said donor ribbon;

a take-up housing positioning said donor ribbon for rotation about a take-up axis;

a connecting portion linking said supply housing to said take-up housing with said supply axis being separated from the take-up axis by a separation distance A to provide a separation area between said supply housing and said take-up housing;

a supply projection extending between and separating said supply housing and said connecting portion;

a take-up projection extending between and separating said supply housing and said connecting portion;

said supply projection, said donor projection and said connecting portion providing a path for said donor ribbon to travel from said supply housing to a supply side waypoint, across an access window of a length C to a take-up waypoint and to said take-up housing;

wherein said supply housing offsets from said supply spool axis by a supply housing offset distance E, said supply waypoint offset from said supply spool axis by a supply waypoint offset distance D, and further wherein a supply side separation F comprises a difference between said supply housing offset distance E and said supply waypoint offset distance D;

wherein said take up housing offsets from said take-up spool axis by a take-up housing offset distance H, said take-up waypoint offsets from said take-up spool axis by a take-up waypoint offset G,and further wherein a take-up side separation I comprises a difference between said take-up housing offset distance H and said take-up waypoint offset G; and wherein said supply housing. said take-up housing and said connecting portion form a separation area for accommodating a printhead moveable alternatively along either a first accurate path about a pivot outside said separation area and a second accurate path about a pivot within said separation area.

12. The cartridge of claim 11, further comprising a donor perimeter extension length M of sufficient length for positioning a pivot arm, and pivot relative to said thermal donor cartridge said pivot arm and pivot positioned outside a perimeter of said cartridge for moving a printhead within said perimeter between a printing position and a non-printing position.

13. The cartridge of claim 11, wherein a ratio of said supply waypoint offset distance D to said supply side housing offset distance E ranges between 1.3 and 1.9.

14. The cartridge of claim 11, wherein a ratio of take-up waypoint offset distance G to take-up side housing offset distance H (G/H) ranges between aproximally 1.6 and 2.5

15. The cartridge of claim 11, wherein a ratio of a separation distance A to the sum of a length of access window C plus a supply waypoint offset distance D plus a take-up waypoint offset distance G (A/(C+D+G) ranges between approximately 0.5 and 0.95.

16. The cartridge of claim 11, wherein a position of said take-up waypoint when said thermal printer cartridge prints, allows positioning a roller at said access window for said donor ribbon to pass from said roller to said take-up spool without contacting any surface of said thermal printer cartridge.

17. The cartridge of claim 11, wherein said supply projection comprises a shape sufficient for positioning an upper supply side pinch roller approximate to said supply waypoint.

18. A cartridge comprising:

a donor ribbon comprising sets of different donor material patches thereon;

a supply housing comprising at least one exterior surface defining a supply area shaped to position a supply spool for rotation about a supply axis, said supply spool being connected to one end of a supply of donor ribbon, with said supply housing further comprising a supply projection extending away from said at least one of said exterior surface of said supply housing, said supply projection allowing said donor ribbon to pass from said supply area to a supply waypoint;

a take-up housing having at least one exterior surface defining a take-up area shaped to position a take-up spool for rotation about a take-up axis, said take-up spool connecting to another end of said donor ribbon, with said take-up housing having a take-up projection extending away from said at least one exterior surface of said take-up housing said take-up projection allowing said donor ribbon to pass from a take-up waypoint to said take-up area; and a connecting portion holding said supply housing and said take-up housing apart on a common side of said connecting portion to form a separation area therebetween, said connecting portion providing a printing path from said supply waypoint to said take-up waypoint;

wherein supply housing and said take up housing are associate apart and above said supply waypoint and said take-up waypoint; and wherein said supply housing, said take-up housing and said connecting portion form a separation area accommodating a printhead moveable alternatively along either a first accurate about a pivot outside said separation area and a second accurate path about a pivot within said separation area.

* * * * *